United States Patent [19]

Freedman

[11] Patent Number: 4,625,518

[45] Date of Patent: Dec. 2, 1986

[54] ICE MUG

[76] Inventor: Saul E. Freedman, 1156 New Pear St., Vineland, N.J. 08360

[21] Appl. No.: 753,105

[22] Filed: Jul. 9, 1985

[51] Int. Cl.[4] ..... F25C 5/08; F25D 3/08

[52] U.S. Cl. ..... 62/1; 62/349; 62/351; 62/371; 62/457

[58] Field of Search ..... 62/1, 349, 351, 371, 62/530, 60, 457

[56] References Cited

U.S. PATENT DOCUMENTS

| | | | |
|---|---|---|---|
| 1,123,537 | 1/1915 | Huizer | 62/351 |
| 1,477,631 | 12/1923 | Deenihan | 62/349 X |
| 1,881,817 | 10/1932 | Meyer | 62/1 X |
| 2,146,236 | 2/1939 | Stamp | 62/1 X |
| 2,952,133 | 9/1960 | Miller | 62/1 |
| 3,065,606 | 11/1962 | Reynolds | 62/1 |
| 3,091,194 | 5/1963 | Dickinson | 62/1 X |
| 4,505,121 | 3/1985 | Gram | 62/371 X |

*Primary Examiner*—Lloyd L. King

*Attorney, Agent, or Firm*—Steele, Gould & Fried

[57] ABSTRACT

An ice mug and method and apparatus for forming the ice mug is disclosed wherein the ice mug includes a frozen container and a non-frozen handle secured thereto. The ice mug container includes integral frozen sidewalls and bottom and a generally C-shaped handle is utilized with the ends embedded in the container sidewalls. The container may be formed with either a one-piece or multi-piece mold and the handle can be secured to the frozen container either during or after the freezing operation.

5 Claims, 5 Drawing Figures

ICE MUG

BACKGROUND OF THE INVENTION

1. Field of the Invention

The present invention relates generally to the field of frozen products, and more particularly, relates to a practical and inexpensive beverage container comprised primarily of molded, frozen ice.

2. Description of the Prior Art

Drinking cups and other vessels fabricated of ice and designed to hold liquid contents have been developed by prior workers in the art. Such prior art frozen containers are exemplified by U.S. Pat. No. 1,123,537 to Huizer, U.S. Pat. No. 2,952,133 to Miller and U.S. Pat. No. 3,065,606 to Reynolds. All of these prior art containers were particularly designed to be utilized in conjunction with an accompanying, non-frozen vessel or holder to facilitate ease in handling to prevent frost-bite or other discomfort to the user and to render the device more acceptable to the average customer. The applicant is also aware of U.S. Pat. No. 1,943,384 to Hall and U.S. Pat. No. 1,915,614 to Parker which relate respectively to a frozen, edible container and a lollipop construction including a partially embedded flexible handle.

So far as is known to the Applicant, no one to date has successfully developed a frozen mug construction that is capable of being readily used without discomfort to the hands and which is essentially completely consumed during and after use to thereby maintain disposal requirements to a minimum.

SUMMARY OF THE INVENTION

The present invention relates generally to the field of frozen containers, and more particularly, is directed to an ice mug that can be quickly and inexpensively formed and which is consumed almost entirely during and after use.

This invention comprises a relatively thick-walled container formed in known manner within a suitable mold by freezing water or other suitable liquid. A handle comprising non-frozen material is securely embedded within the side wall of the frozen container either when the frozen container itself is molded or after molding by utilizing a separate operation following the ice mug formation by freezing.

In a first embodiment, a simple one piece mold having an open top and closed bottom is utilized to form the container of the desired exterior and interior configuration. The one piece mold is first filled with a freezable, edible liquid and is then introduced into a freezing environment, such as a conventional freezer. After freezing, the molded or frozen product can be removed from the one piece mold container in known manner to thereby provide a suitable frozen container comprising integrally molded side walls and bottom construction. The container is molded of suitable dimensions and configuration to receive and contain therein a liquid beverage, for example, a soda drink, fruit juice, punch, lemonade, beer, etc., in a manner to both contain the beverage and to quickly cool the drink to speedily make it palletable for use. It is noteworthly that portions of the frozen container will be melted directly into the beverage when the beverage is cooled. Following use of the ice mug, the frozen container portion will substantially entirely melt to thereby be readily disposed of by melting without creating any type of environmental or disposal problems.

When using the one piece mold embodiment, after formation of the frozen container, it is contemplated that some type of electrically or otherwise heated tool will be applied in two vertically spaced locations against the outer periphery of the frozen container sidewalls to locally melt two discrete portions of the outer periphery of the sidewalls. Once the local areas have sufficiently melted to create spaced liquid puddles in the melted areas, a separate handle can then be associated with the frozen container portion of the ice mug by inserting the ends of the handle into the melted areas. Upon again subjecting the frozen container to freezing conditions, the locally melted area will solidify and freeze about the handle ends, thereby securely associating the handle with the frozen container to form the ice mug of the present invention.

As presently contemplated, the handle construction will be fabricated of thin, bent wood, suitably shaped plastic, or other inexpensive, relatively rigid material which will hold its shape upon use and which will be uneffected by freezing. Accordingly then, once the handle has been associated with the frozen container portion of the mug, a convenient, non-frozen gripping handle will be provided to thereby allow ready use of the ice mug without any discomfort to the hands of the user.

In a second embodiment, it is contemplated that the configuration of the ice mug can be formed by utilizing a three piece mold wherein the ends of a separate suitably configured handle can be introduced directly within the mold construction while the water or other liquid is being solidified into ice whereby the ends of the handle will be securely affixed to the ice mug container side walls during the mug forming procedures. In the second embodiment, when the mold is removed from the frozen ice mug, the handle will then be securely affixed and the mug will be immediately ready for use without further processing operations.

It is therefore an object of the present invention to provide an improved ice mug of the type set forth.

It is another object of the present invention to provide a novel ice mug construction comprising essentially a frozen container and a non-frozen handle securely affixed to the container.

It is another object of the present invention to provide a novel method of forming an ice mug construction comprising utilizing a one piece mold to form the bottom and integral side walls of the present container, placing the mold within a freezing atmosphere and freezing water and other liquid to the desired configuration within the mold, removing the mold from the freezing atmosphere and discharging the frozen container from the mold, applying local heat to at least one portion of the frozen container side wall to melt a small area, inserting one end of a handle into the melted area and refreezing the melted area to secure the handle to the frozen container.

It is another object of the present invention to provide a novel method of forming an ice mug utilizing a three piece mold wherein a frozen container can be formed and a non-frozen handle can be secured directly to the frozen container in a single operation.

It is another object of the present invention to provide a novel ice mug and method of making the same that is inexpensive in manufacture, simple in design and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views, and in which:

DESCRIPTION OF THE PREFERRED EMBODIMENT IN THE PRESENT INVENTION

Figure 1:
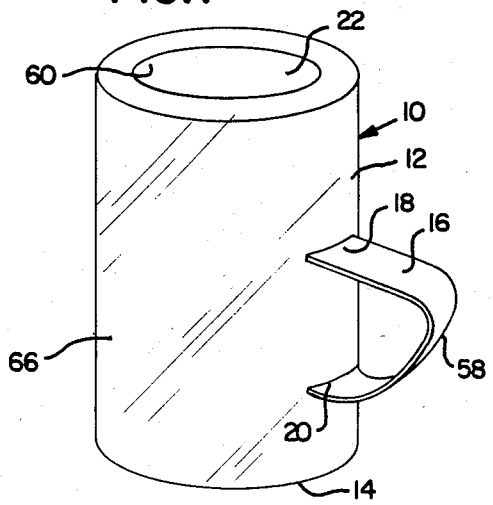
FIG. 1 is a perspective view of an ice mug constructed in accordance with the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 a frozen mug 10 constructed in accordance with the present invention. The mug 10 comprises generally a frozen container 66 having a relatively thick frozen bottom 14 and an integral, upwardly extending sidewall 12 defining a hollow interior space 22 within which a beverage to be cooled prior to drinking (not shown) can be poured in well-known manner.

Figure 2:
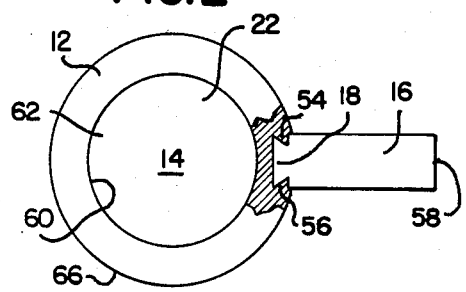
FIG. 2 is a top plan view of the mug of FIG. 1, partially broken away to expose interior construction details.

As illustrated in FIGS. 1 and 2, a handle 16 which preferably may be fabricated of thin, bent wood, suitable plastic, or the like is bent to a generally C-shaped configuration comprising a bent gripping portion 58 and a pair of vertically spaced upper and lower ends 18, 20. Preferably, the handle ends 18, 20 are cut or otherwise worked to form irregular surfaces or end notches 54, 56 to provide an extremely simple, yet strong gripping area for associating the handle 16 with the ice mug container sidewalls 12 in the manner hereinafter more fully set forth.

By employing a flat wood, plastic or other suitable non-frozen material for ice mug gripping purposes, the user (not shown) will easily be able to grasp the ice mug 10 for imbibing the liquid contents thereof without any discomfort and without having to actually touch any of the frozen components of the invention. When a liquid drink is poured into the hollow interior 22 of the frozen mug 10, the interior periphery 60 of the frozen container sidewalls 12 and the interior periphery 62 of the frozen bottom 14 will begin to melt to thereby quickly cool the liquid contents (not shown) in view of the cold nature of the interior periphery of the ice mug and especially in view of the large areas of surface to surface contact between the frozen portions of the ice mug and the liquid contents.

Figure 3:
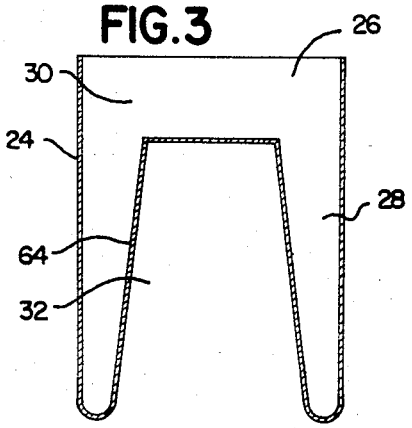
FIG. 3 is a cross sectional view showing a one piece mold of suitable configuration for forming the frozen container portion of the ice mug.

In order to form the frozen mug construction set forth in FIGS. 1 and 2, a one piece mold 24 as illustrated in FIG. 3 may be employed for this purpose. As shown, the one piece mold 24 comprises generally an open top 26 to receive therein water or other liquid in liquid form prior to freezing and to discharge or release therefrom the frozen container 66 upon completion of the freezing operation.

Still referring to FIG. 3, the one piece mold 24 is formed with a generally cylindrical annular area 28 of suitable configuration to form the sidewalls 12 of the frozen container. A solid base area 30 communicates with the annular area 28 to thereby provide the integral bottom and sidewall of the frozen container as above discussed. A shaped interior baffle wall 64 is provided of generally hollow, cylindrical construction to provide a central cavity 32 to form the corresponding hollow interior 22 of the frozen mug 10. Of course, the configurations of the annular area 28 and the solid base area 30 may be varied in dimensions and shape in known manner in order to form the desired end shape of the frozen mug container.

In use, the one piece mold 24 is positioned with the open top 26 facing upwardly to receive therein a quantity of water or other liquid to be frozen in the mold to the desired configuration. After the mold 24 is filled through the open top 26 thereof, it is then placed in known manner in a freezing atmosphere (not shown) such as a conventional freezer and held therein for a sufficient period of time to solidify and freeze the liquid contents (not shown) thereof. After the liquid contents have been properly frozen, the one piece mold 24 can be removed from the freezing environment and the frozen product is then released from the mold in known manner.

The frozen product, which will form the ice mug frozen container 66, is then worked with some type of handle attaching tool 34, which tool comprises essentially a pair of spaced heating elements 36, 38, which elements may be heated by electricity or otherwise in known manner. The spaced heating elements 36, 38 should be applied directly against space portions of the outer periphery of the container sidewalls 12 to melt small portions of the sidewalls to form an upper melted area 40 and a lower melted area 42. Preferably, the ice mug container 66 will be positioned on its side during this operation to prevent run off of the melted liquid from the melted areas 40, 42. After the upper and lower melted areas 40, 42 are thus formed, the configured ends 18, 20 of the bent handle 16 will be inserted directly into the melted areas 40, 42 so that the ends of the handle can be securely embedded within the container sidewalls 12.

With the ends 18, 20 of the handle so positioned, the entire combination of the ice mug container 66 and the bent handle 16 will then be again placed within the freezing atmosphere (not illustrated) for an additional short period of time as may be necessary until the melted areas 40, 42 solidify to thus encapsulate the handle ends 18, 20 within the ice mug sidewall construction. In this manner, a non-frozen handle 16 securely associated with a frozen container 66 will thereby be provided so that the frozen mug 10 can be readily used for beverage containing and drinking purposes without discomfort to the user and without the need for the user to actually touch any portion of the frozen areas of the ice mug 10.

Figure 5:
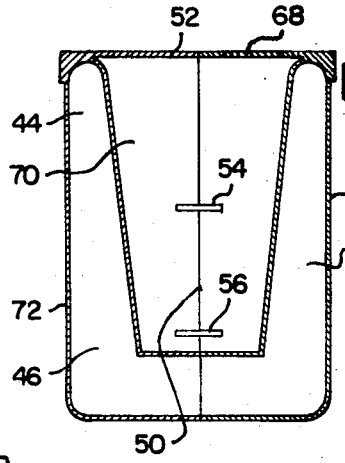
FIG. 5 is a side elevational view of a three part mold for forming the ice mug of the present invention, partially broken away to expose interior construction details.
Figure 4:
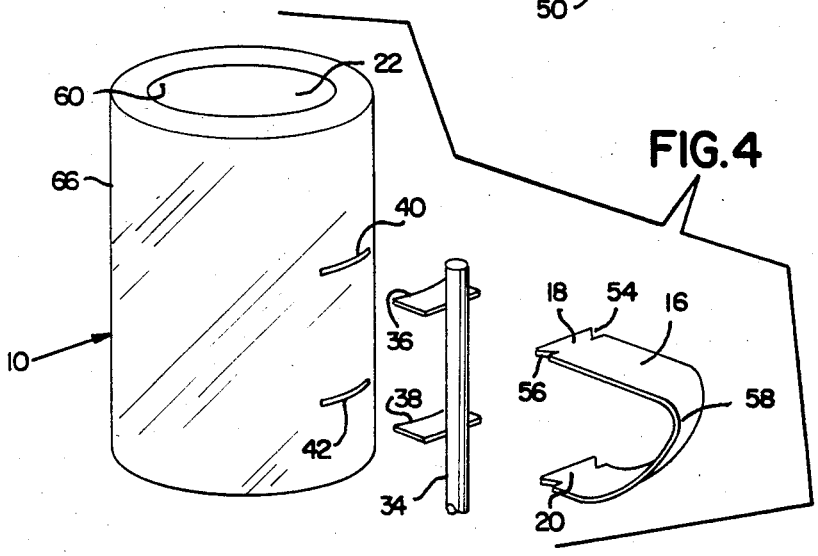
FIG. 4 is an exploded perspective view showing the application of local heat to two vertically spaced locations for handle insertion purposes.

Referring now to FIG. 5, there is illustrated a second embodiment of the invention wherein a three piece mold 44 for forming the ice mug container 66 is illustrated. The three piece mold 44 comprises a left mold half 46 in association with a right mold half 48, which mold halves are joined together along a break away seam or parting line 50. In this embodiment, upper and lower notches 54, 56 are provided to receive therein the ends 18, 20 of the handle 16 prior to freezing. The third portion of the three piece mold 44 comprises a lid mold 52 having a generally flat top or lid 68 and a depending inner cup mold 70. The shape or configuration of the inner cup mold 70 and the outer walls 72, 74 of the left and right mold parts 46, 48 may be configured as desired to produce a shaped, frozen ice mug container 66 of any desired final configuration. As above set forth, in this embodiment, the ends of the handle 16 are inserted directly into the upper and lower handle notches 54, 56 whereby the handle will be embedded in and secured within the sidewalls 12 of the ice mug container 66 when the container is formed by utilizing the three part mold 44.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. The method of forming an ice mug having a frozen container having a hollow interior and a handle means of non-freezable material comprising the steps of fabricating a one-piece mold having an open top, sidewalls defining a bottomly closed annular area and a shaped interior baffle;

positioning the open mold top upwardly and filling the mold with a freezable, consumable liquid;

freezing the liquid within the mold to form the frozen container and conforming the hollow interior of the container to the shape of the interior baffle and sidewalls;

releasing the frozen container form the mold;

applying heat to at least one portion of the sidewalls and forming at least one melted area;

inserting a portion of the handle means into the melted area and refreezing the melted area;

whereby an ice mug comprising a frozen container with a partially embedded, non-frozen handle means is provided.

2. The method of claim 1 wherein the applying comprises applying heat in two spaced locations and the inserting comprises inserting spaced portions of the handle means respectively into the melted areas.

3. The method of claim 2 and the step of rotating the frozen container through one hundred and eighty degrees from its orientation when formed and facing the hollow interior upwardly prior to use.

4. The method of forming an ice mug of the type having a container with an integral frozen bottom and sidewalls and a non-frozen handle means extending from the sidewalls comprising fabricating a multi-piece mold to form a frozen container having an integral bottom and upwardly extending sidewalls;

positioning at least one portion of the non-freezable handle means interiorly of the mold;

filling the mold with an edible liquid and freezing the liquid within the mold to form the container;

embedding the said at least one portion of the handle means in the container sidewalls while freezing; and removing the mold and providing an ice mug with the handle means secured within the sidewall construction.

5. The method of claim 4 and the additional step of configuring the at least one portion of the handle prior to positioning to enhance the embedding.

* * * * *